United States Patent [19]

Sueyoshi et al.

[11] Patent Number: 4,750,893

[45] Date of Patent: Jun. 14, 1988

[54] CONNECTOR

[75] Inventors: Tadahiro Sueyoshi; Yoshitsugu Sawada; Tomohiro Ikeda, all of Kosai, Japan

[73] Assignee: Yazaki Corporation, Tokyo, Japan

[21] Appl. No.: 912,367

[22] Filed: Sep. 26, 1986

[30] Foreign Application Priority Data

Sep. 30, 1985 [JP] Japan ..... 60-148036[U]
Feb. 19, 1986 [JP] Japan ..... 61-021556[U]

[51] Int. Cl.[4] ..... H01R 13/40
[52] U.S. Cl. ..... 439/596; 439/586
[58] Field of Search ..... 339/59–61; 439/586, 594, 596, 598, 603, 701, 372

[56] References Cited

U.S. PATENT DOCUMENTS

| | | | |
|---|---|---|---|
| 4,114,971 | 9/1978 | Heimbrock | 339/59 R |
| 4,418,978 | 12/1983 | Shamir | 439/596 |
| 4,607,903 | 8/1986 | Hoshino et al. | 339/59 R |
| 4,660,914 | 4/1987 | Nakamura | 439/596 |
| 4,674,814 | 6/1987 | Hoshino et al. | 439/586 |
| 4,679,884 | 7/1987 | Klemp | 439/596 |

*Primary Examiner*—Gil Weidenfeld

*Assistant Examiner*—Paula A. Austin

*Attorney, Agent, or Firm*—Balogh, Osann, Kramer, Dvorak, Genova & Traub

[57] ABSTRACT

A connector for electric connection comprises an insulator housing having a plurality of flaps hingedly connected for individual opening and closing movement to a wall of the insulating housing. Each of the flaps has a terminal holding projection thereon which, in a closed position, extends through an opening formed in the wall into one of a plurality of terminal receiving chambers of the housing and holds a terminal inserted in the terminal chamber from being pulled off the housing. A companion insulator housing has a plurality of half insertion detecting projections formed therein corresponding to the flaps of the insulator housing for engaging with the flaps abutted with terminals inserted in the terminal receiving chambers to detect incomplete insertion of the terminals into the terminal receiving chambers. The terminal holding projection may be formed as a pair of flexible arms each having a tapered face and a contiguous chamfered face to facilitate insertion of the terminal holding projection into the opening of the wall of the housing.

5 Claims, 4 Drawing Sheets

CONNECTOR

BACKGROUND OF THE INVENTION

This invention relates to improvements in a connector for electric connection.

A connector having an insulator housing is already known wherein a flap having a pair of locking lugs formed on opposite sides thereof and a plurality of terminal holding shoulders formed thereon corresponding to terminal receiving chambers of the insulator housing is hingedly connected for movement toward and away from a wall of the insulator housing, whereby when the flap is moved toward the wall to close the terminal receiving chambers of the insulator housing, the shoulders are engaged with terminals inserted in the terminal receiving chambers to prevent the terminals from being pulled off the insulator housing while the flap is locked to the housing due to engagement of the locking lugs of the flap with inner side edges of the wall of the housing.

According to the prior art arrangement, if the number of terminals is increased, the width of the flap is increased accordingly. In an insulator housing having such a wide flap, the flap may be locked if only one of the locking lugs operates effectively while it is overlooked that the other locking lug is left unlocked, and hence some terminals may be pulled off the insulator housing. Besides, because a plurality of shoulders are formed integrally on the flap, even when only one of terminal must be replaced, the entire flap must necessarily be opened and closed. Thus, the prior art arrangement is inconvenient for operation. In addition, because the flap is hinged at a rear portion of the insulator housing, the flap may be opened and closed independently of its engagement with or disengagement from a companion housing.

A connector is also known wherein a flap having a terminal fixing element thereon is hingedly connected to a wall of a housing for movement toward and away from the wall, whereby when the flap is moved toward the wall to close an opening formed in the wall and opened to a terminal receiving chamber of the insulator housing, the terminal fixing element is engaged with a terminal inserted in the terminal receiving chamber to prevent the terminal from being pulled off the housing while the flap is locked to the housing due to engagement of a pair of laterally extending locking lugs of the terminal fixing element with inner side edges of the wall of the housing defining the opening. Lower faces of the locking lugs are tapered to push the inner side edges of the opening outwardly from each other to allow the terminal fixing element to pass therethrough.

However, in the conventional connector described just above, the width B1 of the terminal fixing element, that is, the dimension between opposite end faces of the locking lugs of the terminal fixing element, is somewhat greater than the width B2 of the opening, and as the lap width which can be indicated by the difference $\Delta B$ between them, that is, B1–B2, increases, the terminal locking force of the housing increases. But this also increases the force required to press the terminal fixing element into the opening. As a result, plastic deformation may appear at the locking lugs of the terminal fixing element and/or a wall portion of the opening of the insulator housing to disable further fitting or removal of the terminal into or out of the opening.

Further, when the terminal fixing element is to be pressed into the opening, it is first engaged at positions thereof relatively remote from the hinge with the edges of the opening. Therefore, a relatively great force is required actually to press the terminal fixing element into the opening.

SUMMARY OF THE INVENTION

It is an object of the present invention to provide a connector which eliminates such drawbacks of the conventional connector as described above.

It is another object of the invention to provide a connector wherein a flap can be hingedly opened and closed for each of terminals received in a housing thereof and the terminals and the flap can be locked assuredly.

It is a further object of the invention to provide a connector wherein an operation to check complete insertion of all terminals can be done at a time when a housing thereof is fitted with a companion housing thereof.

It is a still another object of the invention to provide a connector which can be used repetitively and can be improved in operability.

In order to attain the objects, according to the present invention, a connector comprises an insulator housing having a plurality of terminal receiving chambers formed therein which are opened at opposite ends thereof, the insulator housing having a first shoulder provided adjacent one end of each of the terminal receiving chambers adjacent which the insulator housing is fitted with a companion insulator housing of the connector for preventing insertion of a terminal into the terminal receiving chamber from the end, the insulator housing further having a plurality of flaps formed by part of a wall of the insulating housing and connected for opening and closing movement to the wall of the insulating housing each by way of a hinge which extends in a direction transverse to the longitudinal axial direction of the terminal receiving chambers, each of the flaps having a projection constituting a second shoulder which extends, upon closing of the flap, into a corresponding one of the terminal receiving chambers so that a terminal inserted in the terminal receiving chamber may not be pulled off from the terminal insertion side of the terminal receiving chamber, each of the flaps extending from the hinge in a direction away from the one end to the other end of the corresponding terminal receiving chamber, each of the second shoulders having a locking portion provided thereon for engaging with a terminal inserted in the corresponding terminal receiving chamber.

Accordingly, when terminals are inserted into the insulating housing, they can be locked assuredly while insertion conditions thereof are acknowledged well by an operator. Besides, upon fitting of the insulating housing with a companion housing, incomplete insertion of the terminals into the insulating housing can be checked, and while the insulating housing is held fitted with the companion housing, the flaps can be protected from outside.

DESCRIPTION OF THE PREFERRED EMBODIMENTS

Figure 6:
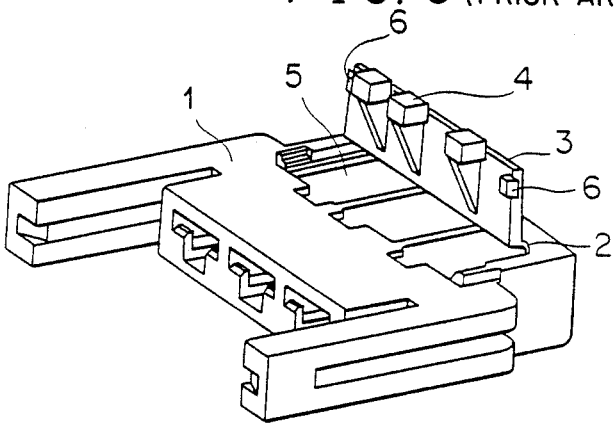
FIG. 6 (PRIOR ART)
FIG. 6 is a perspective view showing a conventional connector.

Referring first to FIG. 6, a conventional connector having an insulator housing as disclosed in Japanese Publication Pat. No. 57-52715 is shown. The insulator housing denoted at 1 has a flap 3 formed as part of a housing wall at a rear portion thereof and connected to the housing wall for opening and closing movement by way of a hinge portion 2. A plurality of second shoulder 4 for holding a terminal are located corresponding to the terminal receiving chambers 5 on the flap 3, and a pair of locking means 6 are located on opposite left and right side edges of the flap 3. Thus, if the flap 3 is fallen forwardly to a closed position, the second shoulders 4 are engaged with terminals received in the insulator housing 1 thereby to prevent the terminals from being pulled off the insulator housing 1. Simultaneously, the flap 3 and the housing 1 are locked to each other by the locking means 6.

Referring now to FIGS. 8 to 11, another conventional connector will be described. The connector is formed as a connector for a female terminal and includes a connector housing 51 having a single terminal receiving chamber 52 formed therein. A flap 59 is connected to an upper wall 53 of the connector housing 51 by way of a resilient hinge 54 and has a terminal fixing element 55 projectingly provided thereon. An opening 56 for receiving the terminal fixing element 55 inserted therein is formed in the upper wall 53 of the connector housing 51. A flexible lance 58 is formed on a bottom wall 57 of the connector housing 51 and extends forwardly within the terminal receiving chamber 52.

The terminal fixing element 55 has at its front a terminal fixing face 55*a* and on its opposite sides a pair of laterally extending holding projections 55*b* for engaging with inner wall face portions of the upper wall 53 adjacent the opening 56. The projections 55*b* of the terminal fixing element 55 are each tapered at a lower face thereof as at 55*c*.

Figure 8:
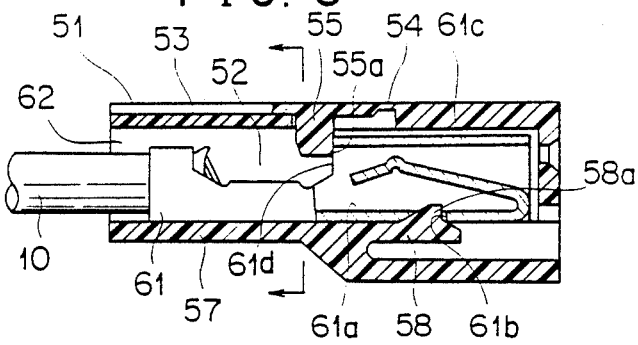
FIG. 8 is a side elevational cross sectional view showing another conventional connector.
Figure 9:
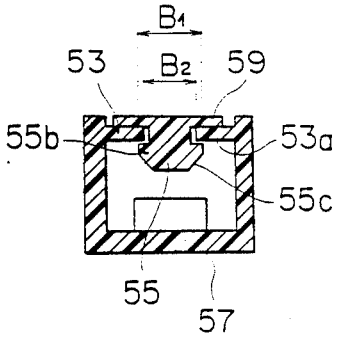
FIG. 9 is a front elevational cross sectional view of the connector of FIG. 8.
Figure 10:
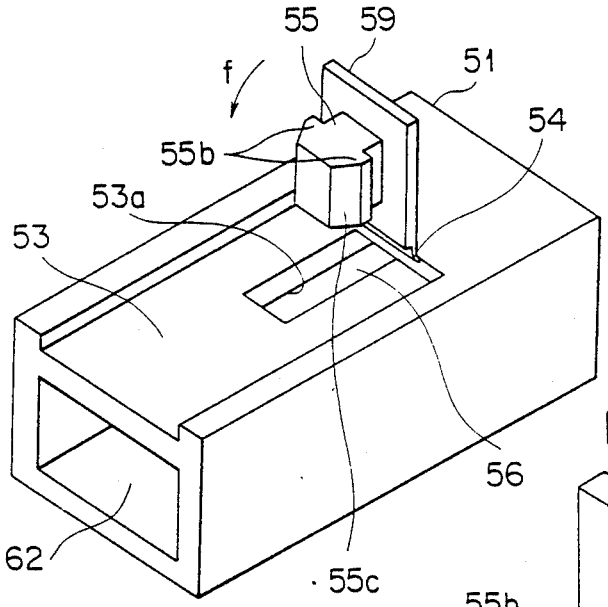
FIG. 10 is a perspective view of the connector of FIG. 8.

In assembling a terminal to the connector described above, with the terminal fixing element 55 opened above the opening 56 as seen in FIG. 10 due to the elasticity of the hinge 54, a terminal 61 to which a wire 60 is securely fixed is inserted into the terminal receiving chamber 52 from a rear insertion opening 62 of the housing 51 until a projection 58*a* of the lance 58 of the connector housing 51 is received in a hole 61*b* formed in a base plate 61*a* of the terminal 61 and fixes the terminal 61 in position. Then, the terminal fixing element 55 is pivoted in a direction indicated by an arrow mark f in FIG. 10 to a closed position in which the holding projections 55*b* thereof are engaged with and held by the inner face 53*a* of the upper wall 53 around the opening 56 while the terminal fixing face 55*a* thereof is abutted with a rear end edge 61*d* of an electric contact member 61*c* of the terminal 61 as shown in FIG. 8.

Figure 7A:
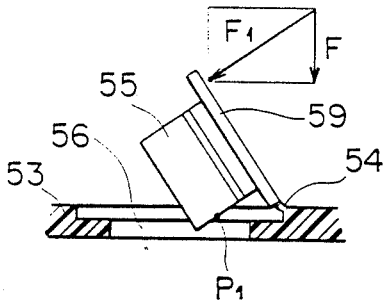
FIGS. 7*a* and 7*b* are diagrammatic cross sectional views comparing the press fitting operation of terminal fixing elements into an opening according to the prior art and the present invention.
Figure 11:
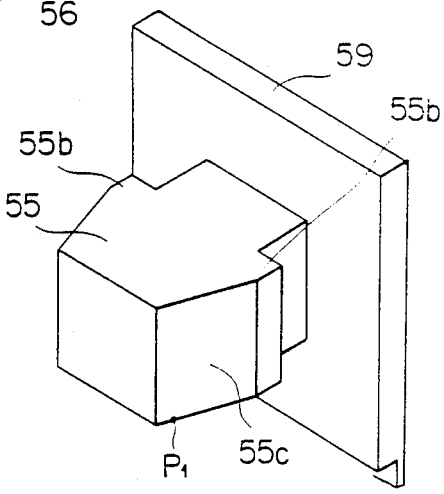
FIG. 11 is an enlarged perspective view of part of the connector of FIG. 10.

When the terminal fixing element 55 is pressed into the opening 56, the tapered faces 55*c* of the holding projections 55*b* of the terminal fixing element 55 act to push the opposite edges of the upper wall 53 around the opening 56 away from each other to allow the holding projections 55*b* to pass downwardly through the opening 56 to its locking position. The width of the terminal fixing element 55, that is, the dimension between opposite end faces of the holding projections 55*b* of the terminal fixing element 55, and the width of the opening 56 are indicated by B1 and B2, respectively, in FIG. 9. Meanwhile, relative positions of the terminal fixing element 55 and the opening 56 when the terminal fixing element 55 is to be pressed into the opening 56 are schematically illustrated in FIG. 7*a*. In FIGS. 7*a* and 11, the position of the terminal fixing element 55 at which it is first engaged with the upper wall 53*a* of the housing 51 is indicated at P1.

Now, a connector according to an embodiment of the present invention will be described in detail with reference to FIGS. 1 to 3. A female terminal T adapted to be received in an insulator housing generally denoted at F of the connector has a receiving section 11 for receiving a companion tab therein formed at a front portion of a base 10 thereof by bending opposite upright side walls 12 of the base 10. At a rear portion of the base 10, a wire W is clamped by a conductor clamping piece 13 and an insulating coating clamping piece 14 in order to connect the wire W to the terminal T. A lance engaging hole 15 is perforated in the receiving section 11 of the base 10, and a resilient contact piece 16 extends from a forward end of the base 10 and is bent backwardly into the receiving section 11 of the terminal T.

The insulator housing F has four terminal receiving chambers 17 arranged in two rows and in two columns and opened at opposite ends thereof each for receiving such a female terminal T as described above therein. A first shoulder 19 is provided adjacent one end 18 of each of the terminal receiving chambers 17 at an end of the insulator housing F at which the insulator housing F is to be fitted with a companion insulator housing generally denoted at M. The first shoulder 19 thus prevents a female terminal from being inserted into a terminal receiving chamber 17 from the end 18 adjacent thereto. A flexible lance 20 is provided on a bottom wall for each of the terminal receiving chambers 17 for resiliently engaging with the lance engaging hole 15 of a female terminal T inserted into the terminal receiving chamber 17 from the other end 21, that is, the terminal insertion side, to prevent the female terminal T from being pulled off in an axial rearward direction.

The insulator housing F further has elongated windows 23 formed individually for the terminal receiving chambers 17 in upper and lower walls 22 thereof and extending along the longitudinal axial direction of the terminal receiving chambers 17. Flaps 24 are formed in an integral relationship with the walls 22 for movement to open and close the windows 23 each by way of a hinge portion 25 extending in a direction transverse to the longitudinal axial direction. Thus, the flaps 24 are provided separately for the terminal receiving chambers 17 as different from the prior art arrangement described above and extend from the hinge portios 25 in a direction away from the first shoulders 19. The flaps 24 are of such a size and shape that they can be fit with the corresponding windows 23 in the insulator housing F. A pair of terminal fixing elements 27 defining second shoulders 26 are formed to project from a portion adjacent a free end of each of the flaps 24, and a pair of engaging pawls 28 of each terminal fixing element 27 serving as locking means for engaging with a rear edge 29 of the receiving section 11 of a female terminal T are formed to project laterally from the second shoulder 26.

The insulator housing M is designed to receive therein male terminals not shown and has at a front half portion thereof a casing section 30 for fittedly receiving an insulating housing F therein. Half insertion detecting projections 31 for preventing incomplete insertion of female terminals F are provided on inner wall faces of the casing section 30 of the insulator housing M corresponding to the flaps 24 of an insulating housing F.

In assembly, a female terminal T is inserted into one of the terminal receiving chambers 17 from the other end 21 until a front end of the receiving section 11 thereof is abutted with the first shoulder 19 and simultaneously the lance 20 for the terminal receiving chamber 17 is engaged with the lance engaging hole 25 thereof in order to effect primary locking of the female terminal T.

Then, the corresponding flap 24 is fallen toward the end 21 to close the window 23. Thereupon, the shoulder 26 of each terminal fixing element 27 on the flap 24 is engaged with the rear edge 29 of the receiving section 11 of the female terminal T and simultaneously the engaging pawls 28 of the shoulder 26 move across the rear edge 29 and is engaged with the interior of the receiving section 11 to lock the female terminal T in position.

Thus, by closing the flap 24, double locking for preventing the female terminal T from being pulled off in an axial rearward direction and locking between the flap 24 and the female terminal T are attained at a same time. Such a series of operations will be performed for each of female terminals to be inserted into the terminal receiving chambers of the insulator housing F.

Then, the insulating housing F is fitted with the casing section 30 of a companion insulator housing M in order to attain coupling of the female and male housings. In this instance, if some of the female terminals T have been inserted incompletely into the insulator housing F, then the corresponding flaps 24 are not in their fully closed conditions due to engagement of the projections 27 thereof with the receiving sections 11 of the female terminals T. Accordingly, the female housing F cannot be fitted with the male housing M by the half insertion detecting projections 31 on the male housing M engaged with the flaps 24 of the female housing F, which allows an operator to acknowledge incomplete insertion of the female terminals T. Further, while the female and male housings are held fitted with each other, the flaps 24 of the female housing F are protected from an external force by the casing section 30 of the male housing M. Accordingly, there is no fear that the flaps 24 may be unlocked, and a complete double locked condition can be assured.

Figure 1:
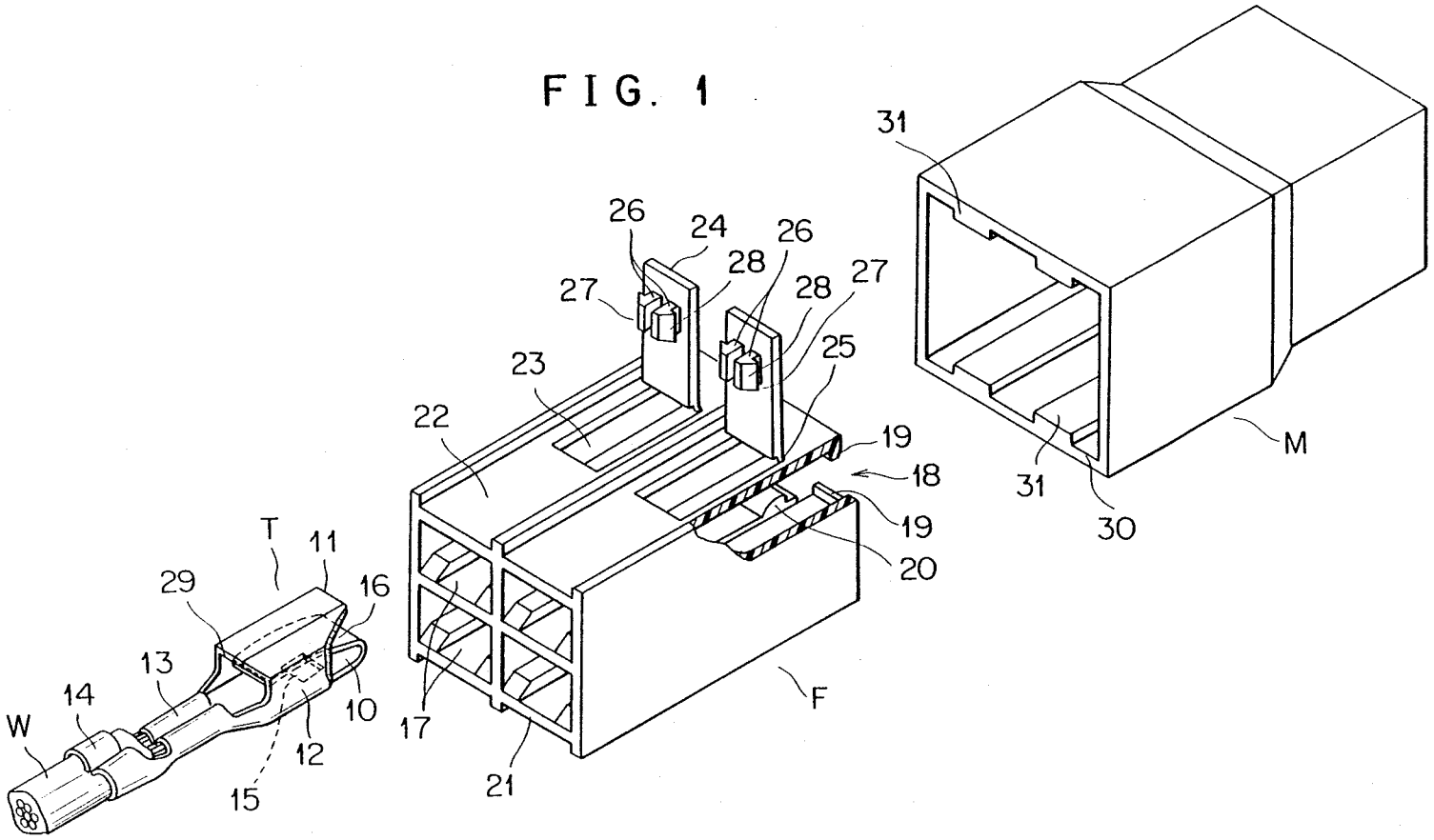
FIG. 1 is a perspective view, partly broken, showing an insulator housing of a connector according to the present invention, a female terminal to be received in the housing and a companion housing.
Figure 2:
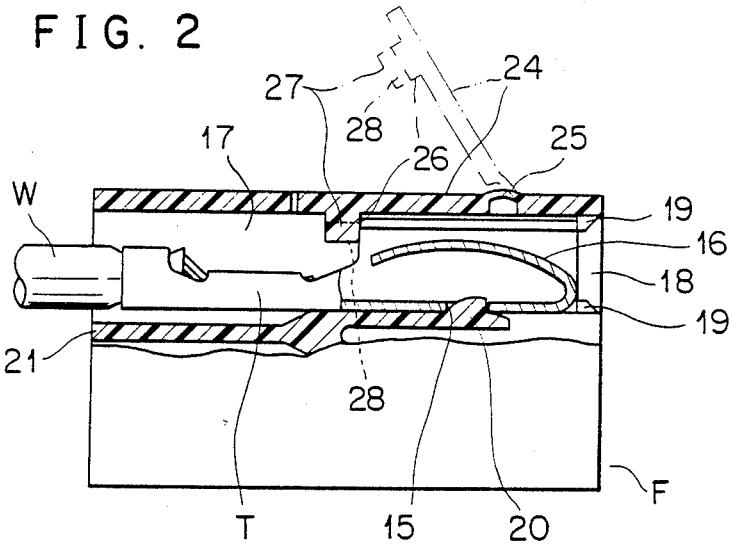
FIG. 2 is a cross sectional view showing the members of the connector of FIG. 1 in an assembled condition.
Figure 3:
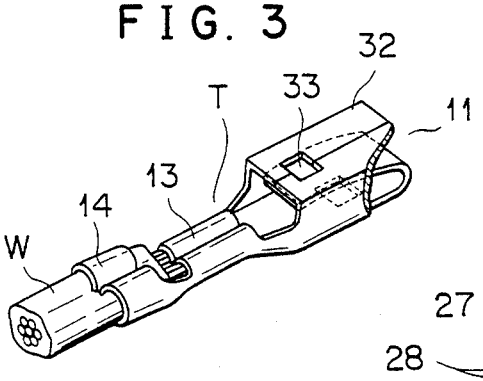
FIG. 3 is a perspective view showing another female terminal which can be applied to an insulator housing of a connector according to the present invention.

While FIG. 1 illustrates an arrangement wherein the shoulder 26 of a flap 24 is engaged with the rear edge 29 of the receiving section 11 of a female terminal T, it can be modified such that a hole 33 be formed in a ceiling wall 32 of the receiving section 11 of the female terminal T so that each terminal fixing element 27 of the flap 24 may be received therein to prevent the female terminal T from being pulled off in an axially forward direction thus in a doubled manner, as shown in FIG. 3. Further, terminals which can be applied to connectors according to the present invention are not limited to female terminals of the type as shown in FIG. 1 but female terminals of the glasses type (formed by curling a pair of resilient clamping arms extending from opposite sides of a base) and male terminals having electric contacts in the form of tabs can also be applied to connectors according to the invention.

Figure 4:
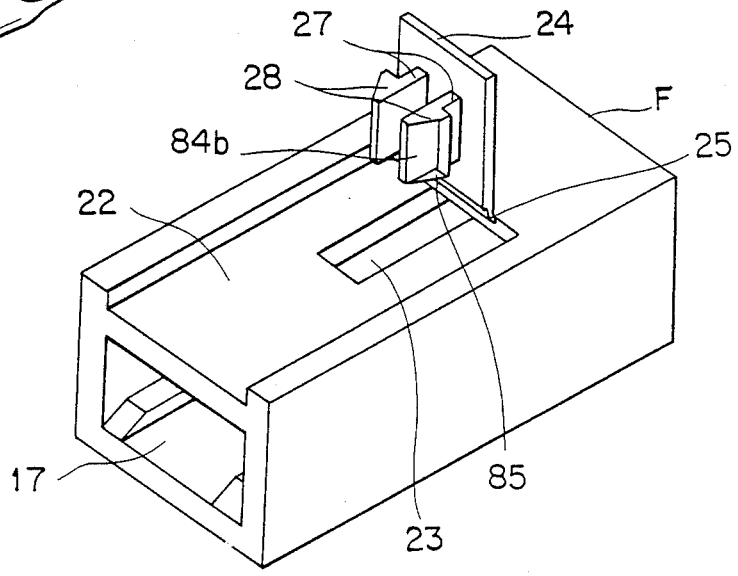
FIG. 4 is an enlarged perspective view showing one of the flaps of the connector housing of FIG. 1.
Figure 5:
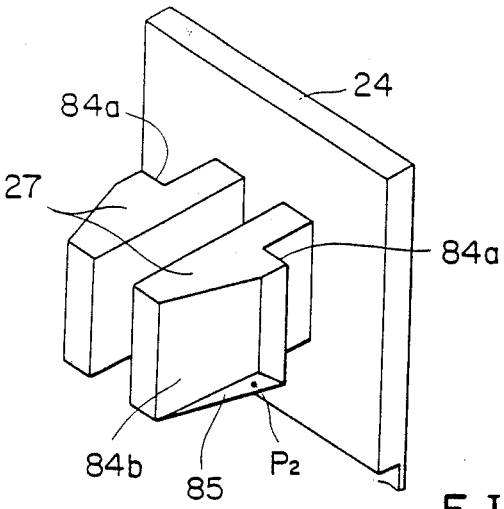
FIG. 5 is a further enlarged perspective view of part of the flap of FIG. 4.

Now, a connector according to the present invention will be described in more detail with reference to FIGS. 4 and 5. In the drawings, one of said receiving chambers 17 and the corresponding flap 24 are depicted independently. The flap 24 is connected to the upper wall 22 of the connector housing F by way of the resilient hinge portions 25 and has a pair of terminal fixing elements 27 each in the form of a flexible are projectingly provided thereon. The window 23 is formed in the upper wall 22 of the connector housing F and adapted to receive the terminal fixing elements 27 inserted therein.

The terminal fixing elements 27 have outwardly extending engaging pawls 28 on outside faces thereof. Each of the engaging pawls 28 has a face **84*a* opposing to the flap 24 and adapted to engage with an inner face of the upper wall 22 of the connector housing F adjacent the window 23, a tapered face 84*b* which is tapered to decrease the thickness of the terminal fixing element 27 toward the extending direction of the terminal fixing element 27, and a chamfered face 85 obliquely intersecting the tapered face 84*b* at an end of the tapered face 84*b* adjacent the hinge 74 for the flap 24**.

It is to be noted that a terminal and means for holding the terminal on a bottom wall of the housing are similar to those of the conventional connector described above and shown in FIGS. 8 to 11.

Assembly of a terminal to the connector having such a construction as described above is also similar to that of the conventional connector as shown in FIGS. 8 to 11, and hence description of the same will be omitted herein. It is to be noted, however, that when the terminal fixing elements 27 are pressed into the window 23 in the upper wall 22, they can be easily deformed resiliently since they have a spacing therebetween as seen in FIGS. 4 and 5.

Accordingly, an excessive load will not be applied to the engaging pawls 28 and the upper wall 22 around the window 23 at all, and hence they will not suffer from plastic deformation.

Figure 7B:
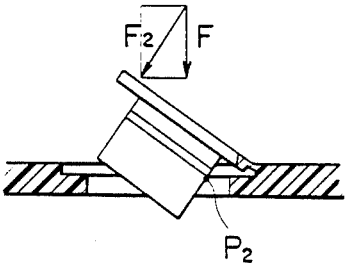

Meanwhile, because the engaging pawls 28 of the terminal fixing elements 27 have the inclined faces 85 located adjacent the ends of the tapered faces **84*b* thereof adjacent the hinge 25 for the flap 24, a point of one of the engaging pawls 28 at which the one engaging pawls 28 is first contacted with the upper wall 22 around the window 23 when the engaging pawls 28 are pressed into the window 23** will be such as indicated at P2 in FIG. 7*b* while such a point in the case of the conventional connector of FIGS. 8 to 11 is a point as indicated at P1 in FIG. 7*a*. Accordingly, the force required to press the terminal fixing elements 27 into the window 23 will be reduced to F2 while such a force required to press the terminal fixing element 55 into the window 56 in the case of the conventional connector as shown in FIGS. 8 to 11 is such as indicated at F1 in FIG. 7*a*.

The required pressing force will be further decreased by elastic deformation of the terminal fixing elements 27 as described above. Such reduction of the pressing force will facilitate an operation of assembling a terminal to a connector and extend the life of the connector.

What is claimed is:

1. A connector comprising an insulator housing having a plurality of terminal receiving chambers formed therein which are opened at opposite ends thereof, said insulator housing having a first shoulder provided adjacent one end of each of said terminal receiving chambers adjacent which said insulator housing is fitted with a companion insulator housing of said connector for preventing insertion of a terminal into the terminal receiving chamber from the end, said insulator housing further having a plurality of flaps formed by part of a wall of said insulating housing and connected for opening and closing movement to said wall of said insulating housing each by way of a hinge which extends in a direction transverse to the longitudinal axial direction of said terminal receiving chambers, each of said flaps having a projection constituting a second shoulder which extends, upon closing of the flap, into a corresponding one of said terminal receiving chambers so that a terminal inserted in the terminal receiving chamber may not be pulled off from the terminal insertion side of the terminal receiving chamber, each of said flaps extending from the hinge in a direction away from the one end to the other end of the corresponding terminal receiving chamber, each of said second shoulders having a locking portion provided thereon for engaging with a terminal inserted in the corresponding terminal receiving chamber, wherein a terminal to be inserted into one of said terminal receiving chambers in said insulator housing has a hole formed therein for engagement by said projection of one of said flaps of said insulator housing to prevent said terminal from being pulled axially off said insulator housing.

2. A connector according to claim 1, wherein said wall of said insulating housing has a plurality of openings formed therein corresponding to said flaps and having a size and shape such that each of said openings may fittedly receive one of said flaps therein.

3. A connector according to claim 1, wherein said wall of said insulating housing has a plurality of openings formed therein corresponding to said flaps and having a width a little smaller than the width of said locking portion of each of said second shoulders.

4. A connector according to claim 1, wherein said companion insulator housing has a plurality of half insertion detecting projections formed therein corresponding to said flaps of said insulator housing for engaging with said flaps abutted with terminals inserted in said terminal receiving chambers to detect incomplete insertion of said terminals into said terminal receiving chambers.

5. A connector comprising an insulator housing having a plurality of terminal receiving chambers formed therein which are opened at opposite ends thereof, said insulator housing having a first shoulder provided adjacent one end of each of said terminal receiving chambers adjacent which said insulator housing is fitted with a companion insulator housing of said connector for preventing insertion of a terminal into the terminal receiving chamber from the end, said insulator housing further having a plurality of flaps formed by part of a wall of said insulating housing and connected for opening and closing movement to said wall of said insulating housing each by way of a hinge which extends in a direction transverse to the longitudinal axial direction of said terminal receiving chambers, each of said flaps having a projection constituting a second shoulder which extends, upon closing of the flap, into a corresponding one of said terminal receiving chambers so that a terminal inserted in the terminal receiving chamber may not be pulled off from the terminal insertion side of the terminal receiving chamber, each of said flaps extending from the hinge in a direction away from the one end to the other end of the corresponding terminal receiving chamber, each of said second shoulders having a locking portion provided thereon for engaging with a terminal inserted in the corresponding terminal receiving chamber, wherein said companion insulator housing has a plurality of half insertion detecting projections formed therein corresponding to said flaps of said insulator housing for engaging with said flaps abutted with terminals inserted in said terminal receiving chambers to detect incomplete insertion of said terminals into said terminal receiving chambers.

* * * * *